US007210178B2

(12) United States Patent
DiGirolamo

(10) Patent No.: US 7,210,178 B2
(45) Date of Patent: May 1, 2007

(54) CONTOUR PILLOW WITH INTERIOR BAFFLE WALLS

(75) Inventor: Shelley A. DiGirolamo, Bellevue, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 10/935,261

(22) Filed: Sep. 7, 2004

(65) Prior Publication Data

US 2006/0048300 A1 Mar. 9, 2006

(51) Int. Cl.
*A47C 20/00* (2006.01)

(52) U.S. Cl. ..... 5/636; 5/645

(58) Field of Classification Search ..... 5/636, 5/950, 644, 645

See application file for complete search history.

(56) References Cited

U.S. PATENT DOCUMENTS

| | | | | | |
|---|---|---|---|---|---|
| 2,589,303 | A * | 3/1952 | Sourbeck | 5/645 |
| 3,521,310 | A * | 7/1970 | Greenawalt | 5/636 |
| 3,829,917 | A | 8/1974 | DeLaittre et al. | 5/338 |
| D254,029 | S | 1/1980 | Barbagallo | D24/36 |
| 4,821,355 | A * | 4/1989 | Burkhardt | 5/636 |
| 4,829,614 | A | 5/1989 | Harper | 5/436 |
| 4,832,007 | A * | 5/1989 | Davis et al. | 250/580 |
| 4,998,309 | A * | 3/1991 | Tesch | 5/636 |
| 5,038,432 | A * | 8/1991 | Robillard et al. | 5/645 |
| 5,138,732 | A * | 8/1992 | Wattie et al. | 5/636 |
| D353,173 | S | 12/1994 | Almeda | D21/191 |
| 5,661,862 | A | 9/1997 | Ryndak | 5/636 |
| 5,682,633 | A | 11/1997 | Davis | 5/636 |
| 5,926,879 | A | 7/1999 | Davis | 5/636 |
| 6,026,330 | A | 2/2000 | Chuang | 607/100 |
| 6,131,219 | A * | 10/2000 | Roberts | 5/644 |
| 6,230,347 | B1 | 5/2001 | Alexander | 5/636 |
| 6,345,401 | B1 | 2/2002 | Frydman | 5/636 |
| D457,771 | S * | 5/2002 | Boxrud | D6/601 |
| 6,397,415 | B1 * | 6/2002 | Hsieh | 5/644 |
| 6,539,568 | B2 | 4/2003 | Lee, Jr. | 5/644 |
| 2003/0046765 | A1 * | 3/2003 | Brown | 5/636 |
| 2004/0154101 | A1 * | 8/2004 | DiGirolamo | 5/490 |
| 2005/0050636 | A1 * | 3/2005 | Setokawa | 5/636 |
| 2005/0102757 | A1 * | 5/2005 | Lee | 5/636 |
| 2005/0210590 | A1 * | 9/2005 | DiGirolamo | 5/636 |

* cited by examiner

*Primary Examiner*—Patricia Engle
*Assistant Examiner*—Gilbert Lee
(74) *Attorney, Agent, or Firm*—Jensen & Puntigam P.S.

(57) ABSTRACT

The pillow includes a pillow body with an upper curved member which includes a first convex curved portion which extends along the length of the upper surface of the pillow near the back edge of the pillow and a second convex curved portion which parallels the first curved portion and extends along the upper surface of the pillow near the front edge of the pillow. A concave curved portion extends between and joins the first and second convex curved portions. The height of the first convex curved portion is greater than the height of the second convex curved portion. A plurality of interior baffle walls extend lengthwise of the pillow, spaced and located so as to maintain the contour of the pillow when the pillow is filled with natural and/or synthetic filling.

8 Claims, 1 Drawing Sheet

FIG. 1
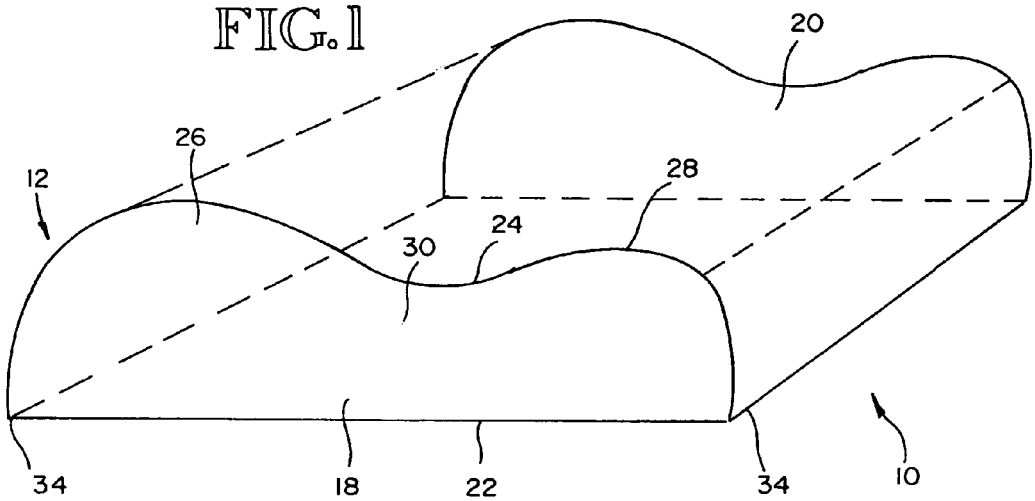
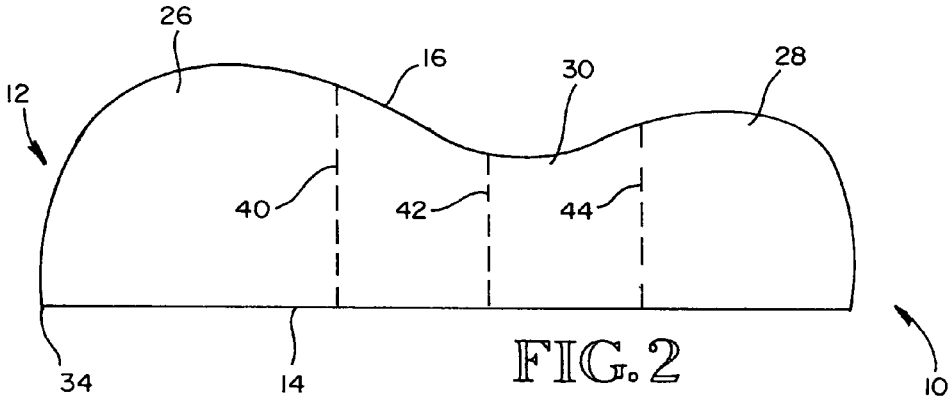
FIG. 2
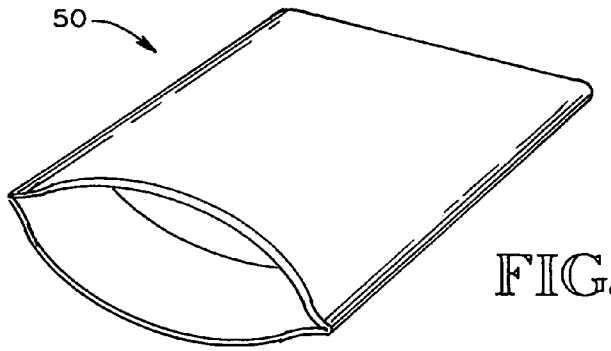
FIG. 3

CONTOUR PILLOW WITH INTERIOR BAFFLE WALLS

TECHNICAL FIELD

This invention relates generally to pillows, and more specifically concerns a pillow with a contoured exterior configuration.

BACKGROUND OF THE INVENTION

Various contour pillow configurations are known, usually providing specialized support for the user. Examples of such pillows include those shown in U.S. Pat. No. 6,345,401 to Frydman and U.S. Pat. No. 3,829,917 to DeLaittre et al. However, such pillows usually are solid foam, or other soft, resilient material, to maintain the contour. This is, for instance, shown clearly in Frydman. It is difficult to maintain a contour arrangement in a pillow with loose filling such as feathers and down. With the present invention, however, a contoured pillow structure is provided which maintains the original contour of the pillow, using a loose filling like feathers, down, other natural filling or comparable synthetic filling, such as polyester or PLA (polylactic acid) material.

SUMMARY OF THE INVENTION

Accordingly, the present invention is a pillow, comprising: a pillow body having an upper curved portion, including a first convex curved portion extending along an upper surface of the pillow near a rear edge thereof, a second convex curved portion extending along the upper surface of the pillow near a front edge thereof, and a concave curved portion joining the first and second curved portions; a plurality of spaced-apart interior baffle members extending approximately parallel to the curved portions, defining chambers within the pillow; and filling in the pillow body, in the chambers defined by the baffle members.

BRIEF DESCRIPTION OF THE DRAWINGS

FIG. 1 is a perspective view of the exterior configuration of the contoured pillow described herein.

FIG. 2 is a lateral cross-sectional view of FIG. 1.

FIG. 3 is a view showing a cover for the pillow of FIGS. 1 and 2.

BEST MODE FOR CARRYING OUT THE INVENTION

FIGS. 1 and 2 show the present contour pillow, with FIG. 1 showing the external contour configuration. The pillow 10 includes a fabric shell 12 which in the embodiment shown is made from a cotton or similar material. Shell 12 includes a flat lower portion 14, an upper curved portion 16 and two opposing flat end portions 18 and 20. Each end portion 18, 20 has a flat lower edge 22 and a curved upper edge 24. In the embodiment shown, pillow 10 is 21½ inches long and 18 inches wide, although these dimensions can be varied.

The upper curved portion 16 of shell 12 includes a rear curved section 26 which extends lengthwise of the pillow between the two end portions 18 and 20, and a front curved section 28 which also extends lengthwise of the pillow between the two end portions 18 and 20 and generally parallels the rear curved section 26. The rear curved section 26 and the front curved section 28 are both convex curves. Between the rear curved section 26 and the front curved section 28, joining the two together, is an intermediate curved section 30 which is concave.

In the embodiment shown, the distance between the flat lower portion 14 of the shell 12 and the high point of rear curved section 26 is 4½ inches, while the distance between the lower portion 14 and the high point of front curved section 28 is 3½ inches. The distance between lower portion 14 and the low point of intermediate curved section 30 is 3 inches.

The upper portion 16 of shell 12 is arranged so that it curves from back to front continuously from rear lower edge 34 of shell 12 through the rear curved section 26, intermediate curved section 30 and front curved section 28 to front lower edge 36.

Extending lengthwise, i.e. longitudinally, of pillow 10 are three interior baffle members 40, 42 and 44. Baffle members 40, 42 and 44 in the embodiment shown extend for the full length of the pillow and parallel each other. Each baffle member is sewn to the interior surfaces of the lower and upper portions 14, 16 of shell 12, and to at least one of the two end portions 18 and 20. In some construction techniques, one end portion is not secured to one end portion, in order to permit convenient filling of the pillow. In the embodiment shown, the interior baffle members are also made of cotton, although this material can be varied as well. The location of the baffle members is important to maintain the loose fill in the pillow in proper position to maintain the contour of the pillow.

In the embodiment shown, baffle member 40 is located approximately halfway between the high point of rear curved section 26 and the low point of intermediate curved section 30. Baffle member 42 is positioned approximately at the low point of intermediate curved section 30, while baffle member 44 is close to the high point of front curved section 28. The location of the baffle members can be varied to some extent, such as over a range of 1–2 inches.

Baffle member 40 is, in the embodiment shown, approximately 4 inches high, while baffle member 42 is 3 inches high and baffle member 44 is 3½ inches high, which is approximately the same as the distance to the high point of the front curved section 28 from the lower portion 14 of shell 12.

The pillow may be filled with either natural filling, e.g. feathers and down, or synthetic, e.g. polyester filling or PLA or similar material. There can also be different fill material in the different chambers defined by the baffle members.

The contour pillow 10 can be provided with a cover which includes fill on one side. FIG. 3 shows a pillow cover 50 into which pillow 10 can be inserted. Filling on the order of 6 ounces of down, is on one side of the cover, the upper side, which covers the contoured surface of the pillow. The cover gives the pillow 10 the appearance of a conventional pillow when it is on the bed, and not in use.

Accordingly, a new pillow configuration has been disclosed, specifically a pillow having a contoured configuration extending lengthwise of the pillow. Interior baffle members are provided which extend lengthwise of the pillow, maintaining the contour with a natural or synthetic loose fill, including a PLA filling.

Although a preferred embodiment of the invention has been disclosed for purposes of illustration, it should be understood that various changes, modifications and substitutions may be incorporated in the embodiment without departing from the spirit of the invention which is defined by the claims which follow:

What is claimed is:

1. A pillow, comprising:

a pillow body having an upper curved portion and a bottom portion, the upper portion including a first convex curved portion extending along an upper surface of the pillow near a rear edge thereof, a second convex curved portion extending along the upper surface of the pillow near a front edge thereof, and a concave curved portion joining the first and second curved portions, wherein the first convex curved portion has a height which is greater than the height of the second convex curved portion;

a plurality of space-part interior baffle members extending between the curved upper portion and the bottom portion of the pillow body in a direction approximately parallel to the curved portions and the front and rear edges of the pillow, defining chambers within the pillow, wherein one baffle member is located approximately at a low point of the concave curved portion, wherein another baffle member is located approximately midway between a high point of the first convex curved portion and the low point of the concave curved portion, and wherein a third baffle member is located close to a high point of the second convex curved portion, wherein the distance from the rear edge of the pillow to said another baffle member is greater than the distance between said another baffle member and said one baffle member and greater than the distance between said one baffle member and said third baffle member, and wherein the distance from said third baffle member to the front edge of the pillow is less than the distance between the rear edge of the pillow and said another baffle member; and filling in the pillow body, in the chambers defined by the baffle members.

2. The pillow of claim 1, wherein the curved portions and the baffle members extend lengthwise of the pillow and wherein the baffle members are approximately parallel to each other.

3. The pillow of claim 1, wherein the bottom portion is approximately flat.

4. The pillow of claim 1, wherein the pillow is filled with either (1) natural feathers or down filling or (2) natural feathers and down filling.

5. The pillow of claim 1, wherein the pillow is filled with synthetic filling or PLA material.

6. The pillow of claim 1, wherein the pillow is filled with either (1) a combination of natural feathers and down filling and synthetic filling, including PLA material or (2) a combination of natural feathers or down filling and synthetic filling, including PLA material.

7. The pillow of claim 1, wherein the pillow body includes two end opposing portions which are substantially flat.

8. The pillow of claim 1, including a cover member enclosing the pillow and filling located between the upper curved portion of the pillow and the cover member.

* * * * *